US007156977B2

(12) United States Patent
Wrisberg et al.

(10) Patent No.: US 7,156,977 B2
(45) Date of Patent: Jan. 2, 2007

(54) HYDROPROCESSING PROCESS AND METHOD OF RETROFITTING EXISTING HYDROPROCESSING REACTORS

(75) Inventors: Johannes Wrisberg, Holte (DK); Arno S. Sorensen, Rungstedt Kyst (DK)

(73) Assignee: Haldor Topsoe A/S, Lyngby (DK)

( * ) Notice: Subject to any disclaimer, the term of this patent is extended or adjusted under 35 U.S.C. 154(b) by 508 days.

(21) Appl. No.: 10/416,026

(22) PCT Filed: Nov. 8, 2001

(86) PCT No.: PCT/EP01/12949

§ 371 (c)(1),
(2), (4) Date: Sep. 15, 2003

(87) PCT Pub. No.: WO02/38704

PCT Pub. Date: May 16, 2002

(65) Prior Publication Data

US 2004/0045870 A1 Mar. 11, 2004

(30) Foreign Application Priority Data

Nov. 11, 2000 (DK) ..... 2000 01691

(51) Int. Cl.
*C10G 69/02* (2006.01)
*B01J 8/04* (2006.01)

(52) U.S. Cl. ..... 208/49; 208/58; 208/59; 422/188; 422/189; 422/193

(58) Field of Classification Search ..... 208/49, 208/58, 59; 422/188, 189, 193
See application file for complete search history.

(56) References Cited

U.S. PATENT DOCUMENTS 2,432,745 A * 12/1947 Wright ..... 208/155
3,528,908 A 9/1970 Bowles et al.
3,554,898 A 1/1971 Wood et al.
3,702,818 A * 11/1972 Streed et al. ..... 208/89
3,816,296 A 6/1974 Hass et al.
3,983,029 A 9/1976 White
4,058,449 A 11/1977 Reitz et al.
4,435,275 A 3/1984 Derr et al.
5,184,386 A * 2/1993 Zardi et al. ..... 29/401.1
5,688,445 A * 11/1997 Wrisberg ..... 261/96
5,942,162 A * 8/1999 Gamborg et al. ..... 261/96
5,968,346 A 10/1999 Jung et al.
6,153,153 A * 11/2000 Jubin et al. ..... 422/235

FOREIGN PATENT DOCUMENTS

| | | |
|---|---|---|
| EP | 0 234 123 | 9/1987 |
| EP | 0 354 623 | 2/1990 |
| GB | 1 191 958 | 5/1970 |
| GB | 1193212 | 5/1970 |
| JP | A-01-185392 | 7/1989 |

* cited by examiner

*Primary Examiner*—Glenn Caldarola
*Assistant Examiner*—John Douglas
(74) *Attorney, Agent, or Firm*—Dickstein Shapiro LLP

(57) ABSTRACT

A process for hydroprocessing a hydrocarbon feed. The hydrocarbon feed is first admixed with a hydrogen rich gas. The resultant process stream is then contacted with a hydrocracking catalyst. The resultant catalyst effluent process stream is separated into a gas phase stream and a liquid phase stream, and the gas phase stream is withdrawn. The liquid phase stream is admixed with a hydrogen rich gas, and the resultant process stream is contacted with a hydrocracking catalyst. The resultant catalyst effluent process stream is withdrawn and admixed with the previously obtained gas phase stream, and the resultant process stream is withdrawn.

5 Claims, 6 Drawing Sheets

AB

HYDROPROCESSING PROCESS AND METHOD OF RETROFITTING EXISTING HYDROPROCESSING REACTORS

BACKGROUND OF THE INVENTION

1. Field of the Invention

The present invention relates to an improved process for hydroprocessing of hydrocarbon feedstock. The process involves interbed separation of gas/liquid phases of a process stream for removal of hydrogenated impurities and gaseous hydrocarbons.

The invention relates further to a method of retrofitting or modernising an existing hydroprocessing reactor for use in the improved process.

2. Description of Related Art

Hydrocarbon feed stocks and in particular heavy hydrocarbons usually contain organic sulphur and nitrogen compounds that in a subsequent process are undesired impurities because they affect catalyst activity. These impurities must therefor be hydrogenated to hydrogen sulphide and ammonia prior to being treated in a subsequent process for further hydroprocessing of the feed stock.

A number of known processes for treatment of heavy hydrocarbon raw material fulfil different requirements concerning feed, product and cost of investment.

Thus, Verachtert et al. (U.S. Pat. No. 5,914,029) disclose a process containing a hydroprocessing reactor, cooling in several heat exchangers, gas/liquid separation and stripping of the liquid hydrocarbon.

Cash (U.S. Pat. No. 6,096,190) mentions a simple process for hydrotreatment of two different feedstocks with a common hydrogen source in one reactor. After cooling and separation, the liquid separator effluent is fed to a distillation tower.

Similarly, Kyan et al. (U.S. Pat. No. 5,603,824) send heavy distillate and light distillate to a common reactor for hydrocracking and subsequent dewaxing.

However, none of the above processes include interbed phase separation and $H_2S/NH_3$ removal and interbed product recovery by gas phase separation.

Both Chervenak et al. (U.S. Pat. No. 4,221,653) and Devenathan et al. (U.S. Pat. No. 5,624,642) disclose hydrocarbon processing including gas/liquid separation inside reactor, however, the catalyst beds involved are fluidised beds requiring recirculation of the liquid phase.

Bridge et al. U.S. Pat. No. 4,615,789 disclose a hydroprocessing reactor containing three fixed catalyst beds, downward gas/liquid flow and gas/liquid separation before the last bed. This process ensures that the liquid phase bypasses the last catalyst bed and that the gas phase process stream undergoes further hydroprocessing in absence of the liquid hydrocarbons.

In WO 97/18278 Bixel et al. describe a process for hydrocracking and dewaxing of an oil feed stock to produce lube oil. The process includes two multi-stage towers, where the process stream is cooled by quenching with hydrogen between the catalyst beds, and after first tower the gas phase of the process stream is recycled to the inlet of this first tower.

Wolk et al. disclose in U.S. Pat. No. 4,111,663 reactors with up-flow of a slurry of coal, oil and gas, where cooling between beds is performed by addition of cold hydrogen or by withdrawing process gas stream, cooling, separating, removing the liquid and returning the gas phase to the reactor between the beds.

In patent No. EP 990,693 Kalnes et al. disclose a process for producing light hydrocarbons by integrated hydrotreating and hydrocracking. In this process, the liquid phase of the effluent and the hydrogen rich gas, after further processing, are returned to the hydrocracker.

In publication DE 2,133,565 Jung et al. describe a process for hydrocracking of hydrocarbon oil, where effluent from first cracker is further processed by distillation and the heaviest fraction is further cracked before being returned to the distillation. The two hydrocracker towers are cooled by hydrogen addition between the beds.

A process for production of coke by McConaghy et al. is disclosed in SE Patent No. 8,006,852, where hydrocarbon feed is cracked in a cracker furnace before being fractionated and some of the heavier hydrocarbons from the fractionator is further hydrogenated before returning to the cracker furnace and fractionator.

In U.S. Pat. No. 3,816,296 Hass et al. describe their process for producing gasoline and midbarrel fuels from higher boiling hydrocarbons. The feed is processed by hydro-refining, cracking, separation with return of the gas phase to hydro-refining inlet and by refractionation of the liquid phase. The heaviest phase from the refractionator is treated in a second cracker, to which also nitrogen compounds are added, in order to control selectivity of the cracking process. The effluent of this second cracker is separated and the gas phase is returned to inlet of second cracker.

Many of the processes of prior art concerning hydroprocessing involve phase separation of a process stream, and the gas phase is returned to the process or recycled to the inlet of the apparatus, which the process stream just has passed through.

Prior art fails to teach separation of gas phase from liquid phase between catalyst beds inside a reactor and returning only the liquid phase with the purposes of removing $H_2S$ and $NH_3$ and the light hydrocarbons in order to avoid excessive cracking of the light hydrocarbons and to avoid sending poisons to the subsequent catalyst beds.

SUMMARY OF THE INVENTION

In one aspect, this invention provides an improved process for hydroprocessing of a hydrocarbon feedstock, where the hydrocarbon feed stock is hydrotreated by contact with a hydrotreating catalyst and hydrocracked in presence of a subsequent hydrocracking catalyst arranged in one or more reactors. Between the hydrotreating step and the hydrocracking step the two-phase process stream is withdrawn between hydrotreating and hydrocracking catalyst for phase separation into a gaseous and liquid phase. The liquid phase is then cycled to the hydrocracking step after fresh hydrogen rich gas has been added to the liquid phase. Phase separation may be repeated after one or more catalyst beds. Upstream beds are thereby loaded with catalyst active in hydrogenation of organic sulphur, nitrogen, aromatic compounds and optionally in hydrocracking of heavy hydrocarbons if contained in the feed stock. Downstream beds contain a catalyst being active in hydrogenation and/or hydrocracking.

In the inventive process a gas phase containing $H_2S$ and $NH_3$ being formed during hydrotreating of the feed stock and being impurities in the hydrocracking step is removed together with gaseous hydrocarbons preventing further, unintended cracking of these hydrocarbons in this step.

In further an aspect, this invention provides a method for retrofitting an existing hydroprocessing reactor to be usable in the above hydroprocessing process. Thereby, an existing hydroprocessing reactor is rebuilt without any change in the reactor shell, and with solely minor changes of reactor internals. The inventive method includes that a cylindrical piece connected to the inside piping is inserted between the top flanges of a typical hydroprocessing reactor, the inlet distributor is prolonged or renewed and risers and downcomers are installed.

DETAILED DESCRIPTION OF THE INVENTION

Heavy hydrocarbon feedstock typically contains organic sulphur, nitrogen and aromatic compounds, which are undesirable in a downstream hydrocracking process and product. When operating the invention in practice, feed oil is admixed with a hydrogen containing gas and heated to reaction temperatures of 250–450° C. before entering a hydroprocessing reactor.

By contact with a hydrotreating catalyst these compounds are converted to $H_2S$, $NH_3$ and saturated hydrocarbons. $H_2S$ and $NH_3$ are impurities that affect catalyst activity and are removed from hydrotreated effluent by phase separation into a liquid and gaseous process stream and withdrawal of the gaseous stream containing light hydrocarbons and the impurities before further hydroprocessing. The liquid stream is admixed with fresh treat gas before entering the hydrocracking step.

In the hydrocracking step or when hydrocracking a liquid hydrocarbon feed not cotaining sulphur or nitrogen compounds the liquid stream is contacted with hydrocracking catalyst being arranged in one or more catalyst beds. When carrying out the process in a number of reactors and/or catalyst beds, a two-phase process stream is withdrawn from between the catalyst beds and/or reactors and the gas phase is removed as described above. Fresh gas rich in hydrogen is added to the liquid process stream before being introduced in a subsequent catalyst bed. Undesired further cracking of hydrocarbons in the gas phase is thereby substantially avoided. Only small amounts of impurities are introduced to downstream catalyst beds, where the liquid process stream is hydrocracked to lower hydrocarbons in a more efficient way and/or at higher space velocity. Lifetime of the catalyst is considerably prolonged.

The interbed phase separation can take place both inside and outside the reactor.

In last case, optionally a catalyst bed can be installed in top of the separator in the gas phase in order to hydrogenate remaining aromatic compounds in the light product.

Depending of the desired product, ammonia can be added to the liquid phase from interbed separation. This will inhibit cracking reaction in the subsequent catalyst bed and allow operation at higher temperature but with unchanged conversion, thereby heavier hydrocarbons than at lower temperatures will leave the reactor with the gas phase between the catalyst beds, and avoid further cracking, which improves the yield of product.

Effluent from the final hydrocracking step is admixed with the gaseous effluents obtained in the above separation steps. The thus formed process stream is cooled and liquid heavy hydrocarbons are separated from the stream, while the remaining gas phase is admixed with water, further cooled and fed to a separation unit. The washed process stream is separated in a sour water phase, a liquid light hydrocarbon phase and a hydrogen rich gas being essentially free of N and S compounds. The hydrogen rich stream together with an amount of make-up hydrogen forms the fresh treat gas stream being admixed to the liquid process streams between the above hydroprocessing steps.

The invention further provides a method for retrofitting existing hydroprocessing reactors for use in a process of this invention. By the method internals of an existing hydroprocessing reactor including optionally additional catalyst beds, risers and downcomers are retrofitted or installed without modifying the expensive reactor shell. In more detail the method comprises

- installing a flanged spool piece between an existing man hole flange at top of the reactor;
- retrofitting existing mixer plates to partition plates;
- installing risers extending from top of the reactor to upper surface of the partition plate between two catalyst beds and installing downcomers extending from top of the reactor to lower surface of the partition plate; and
- providing ducts connecting nozzles on the spool piece with the risers and the downcomers.

In the retrofitted reactor catalyst effluent is withdrawn through an installed riser from the reactor and passed to a separator for treating the effluent as described above. The liquid phase obtained in the separator is admixed with fresh treat gas and returned through installed downcomers to a subsequent catalyst bed.

A retrofit of existing trays to dense pattern flexible trays (U.S. Pat. No. 5,688,445) or trays provided with vapour lift tubes (U.S. Pat. No. 5,942,162) further increase the yield and conversion in process.

In case of internal phase separation, the tray below a catalyst bed is designed to let the liquid phase be collected and transferred through a hole in the middle of the tray to next catalyst bed, while the gas phase is removed through the riser. Above and around the middle of the tray a separating/mixing device, open at the bottom, is installed to which the downcomer with fresh hydrogen rich gas is connected.

By the retrofitting method of the invention, it possible to withdraw and recycle process streams between the catalyst beds without modification of the reactor shell. The inlet pipe of an existing hydroprocessing reactor is typically connected to the cover of 30" manhole at top of reactor. When retrofitting such a conventional hydroprocessing reactor, a cylindrical piece is installed between the flanges of the manhole. The cylindrical piece contains the connections between risers/downcomers inside the hydroprocessing reactor and the piping between the hydroprocessing reactor and a separator.

By the process of the invention, far better use of the catalyst is obtained as well as prolonged catalyst lifetime. Consequently, the requirement to catalyst volume is reduced, which makes space for the retrofit between catalyst beds and still obtaining a higher yield of product.

DETAILED DESCRIPTION OF THE DRAWINGS

Figure 1:
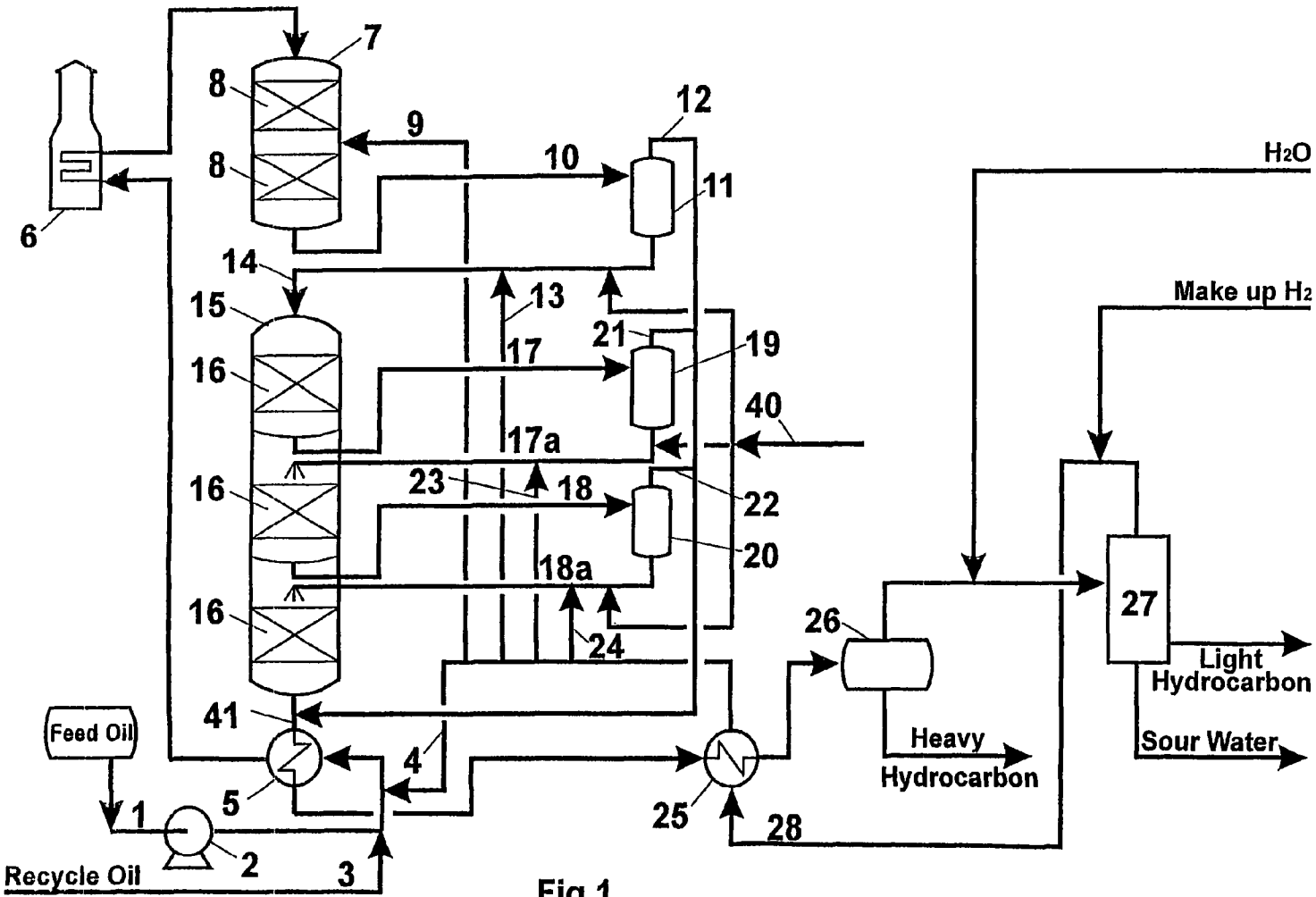
FIG. 1 is a simplified diagram of a process according to a specific embodiment of the invention for hydroprocessing of heavy hydrocarbon feed with phase separation between catalyst beds.

Referring to the drawings, a specific embodiment of the invention is illustrated by the simplified flow diagram of FIG. 1. Feed oil is introduced to the process through line 1 and pumped by pump 2. After admixing of recycle oil in line 3 and then hydrogen rich gas in line 4, the feed mixture is heated in feed/effluent heat exchanger 5 and fired heater 6 before entering hydrogenator 7. Hydrogenator 7 contains two catalyst beds 8 with catalyst being active in hydrogenation of organic compounds including sulphur, nitrogen and aromatic compounds contained in the feed mixture and in hydrocracking of hydrocarbons. To control the temperature in the hydrogenation catalyst, hydrogen rich gas is added through line 9 between the catalyst beds.

Hydrogenator effluent stream 10 enters a separator 11 from where gas phase stream 12 containing $H_2S$, $NH_3$ and cracked hydrocarbons is withdrawn. The liquid separator effluent is admixed with fresh hydrogen rich gas stream 13, and mixed process gas stream 14 is fed to hydrocracker 15. Hydrocracker 15 is provided with catalyst 16 being active in hydrocracking and arranged in three beds. Process streams 17 and 18 between the catalyst beds are withdrawn from the reactor and introduced to separators 19 and 20, from where gas phase streams 21 and 22 are withdrawn. Solely liquid streams 17*a* and 18*a* are recycled to the cracking catalyst after having been admixed with fresh hydrogen rich gas from lines 23 and 24. Thereby cracking of gaseous hydrocarbons is avoided and high conversion in all catalyst beds obtained. If required controlled and small amounts of ammonia are introduced through line 40 into liquid streams 14, 17*a* and 18*a* to improve product selectivity and reduce hydrogen consumption. The hydrocracker effluent 41 is admixed with gaseous process streams 12, 21 and 22 from separators 11, 19 and 20, respectively. The combined process stream is then cooled in feed/effluent heat exchanger 5 and 25 before entering separator 26 from where the heavy hydrocarbon product is withdrawn. The gaseous separator effluent is admixed with water before further cooling (not shown) and introduction into separation unit 27 resulting in a sour water stream, a light hydrocarbon product stream and a fresh hydrogen rich treat gas stream. The hydrogen rich treat gas stream is admixed with make-up hydrogen. The combined treat gas stream 28 is heated in feed/effluent heat exchanger 25 and forms the hydrogen rich gas used in hydrogenator 7 and in hydrocracker 15.

Figure 2:
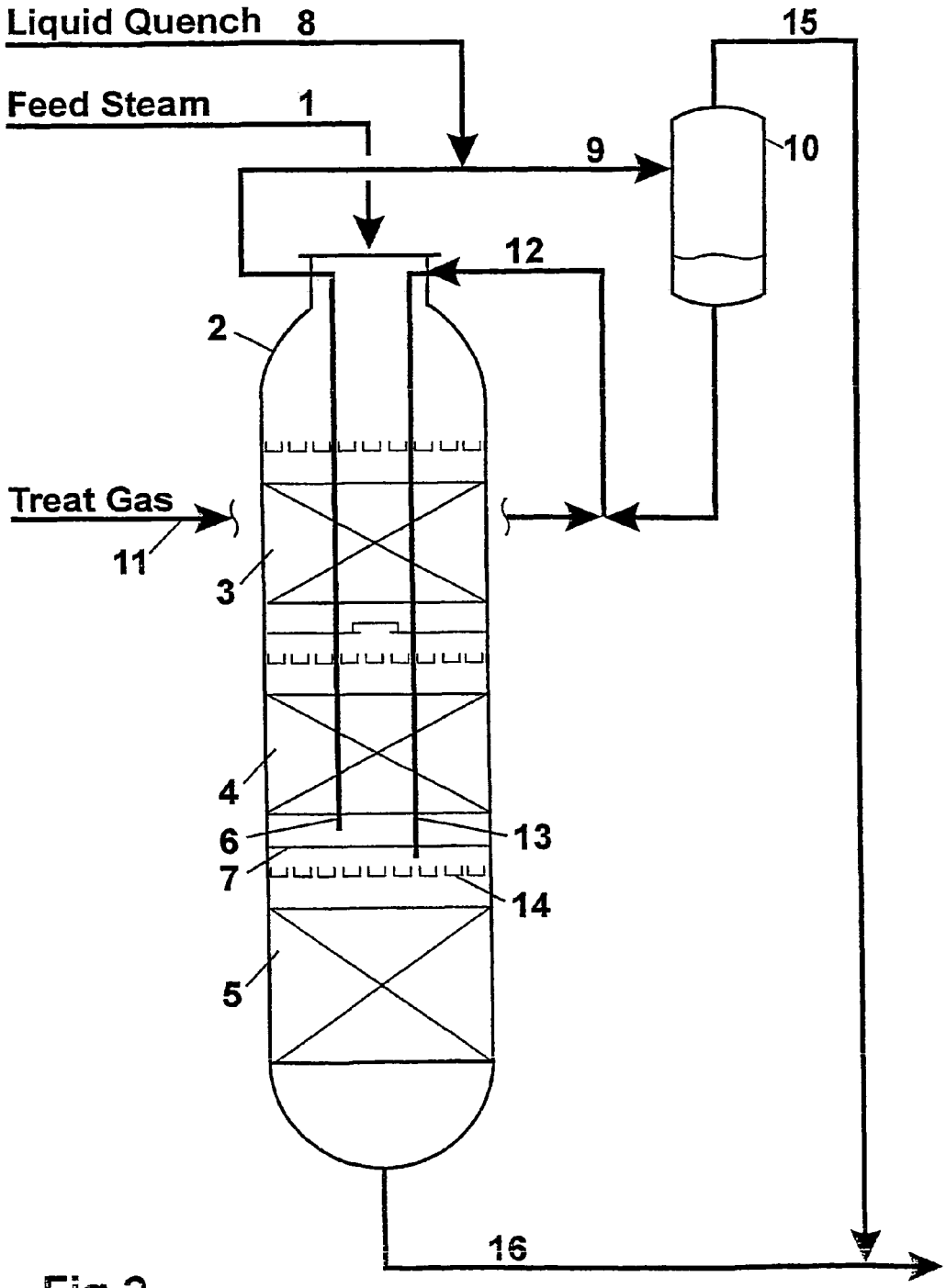
FIG. 2 shows a retrofitted hydroprocessing reactor with external phase separation and addition of fresh treat gas upstream a lower catalyst bed.

FIG. 2 shows a hydroprocessing reactor being retrofitted in accordance with a specific embodiment of the invention.

When operating the reactor, feed stream 1 containing heavy hydrocarbon feed and hydrogen rich gas is introduced to hydroprocessing reactor 2 containing three catalyst beds. Two upper beds 3 and 4 are loaded with catalyst active in hydrogenation of organic sulphur and nitrogen compounds and aromatic compounds and in hydrocracking. Lower bed 5 is loaded with catalyst active in hydrocracking. Effluent from the second catalyst bed is withdrawn through riser 6, extending from top of reactor and to above partition plate 7 below second catalyst bed. After admixing with liquid quench stream 8 process stream 9 enters separator 10. The liquid separator effluent is admixed with fresh hydrogen rich treat gas 11. This process stream 12 enters hydroprocessing reactor 2 and is passed via downcomer 13 to below partition plate 7, but above distribution plate 14 above the third catalyst bed. $H_2S$ and $NH_3$ and light hydrocarbons being formed by hydrogenation of the feed in catalyst bed 3 and 4 are removed with gaseous separator effluent 15. The admixed liquid process stream 12 enters catalyst bed 5, where liquid hydrocarbon is hydrocracked.

Reactor effluent 16 is admixed with gaseous separator effluent 15 for further processing.

Figure 3:
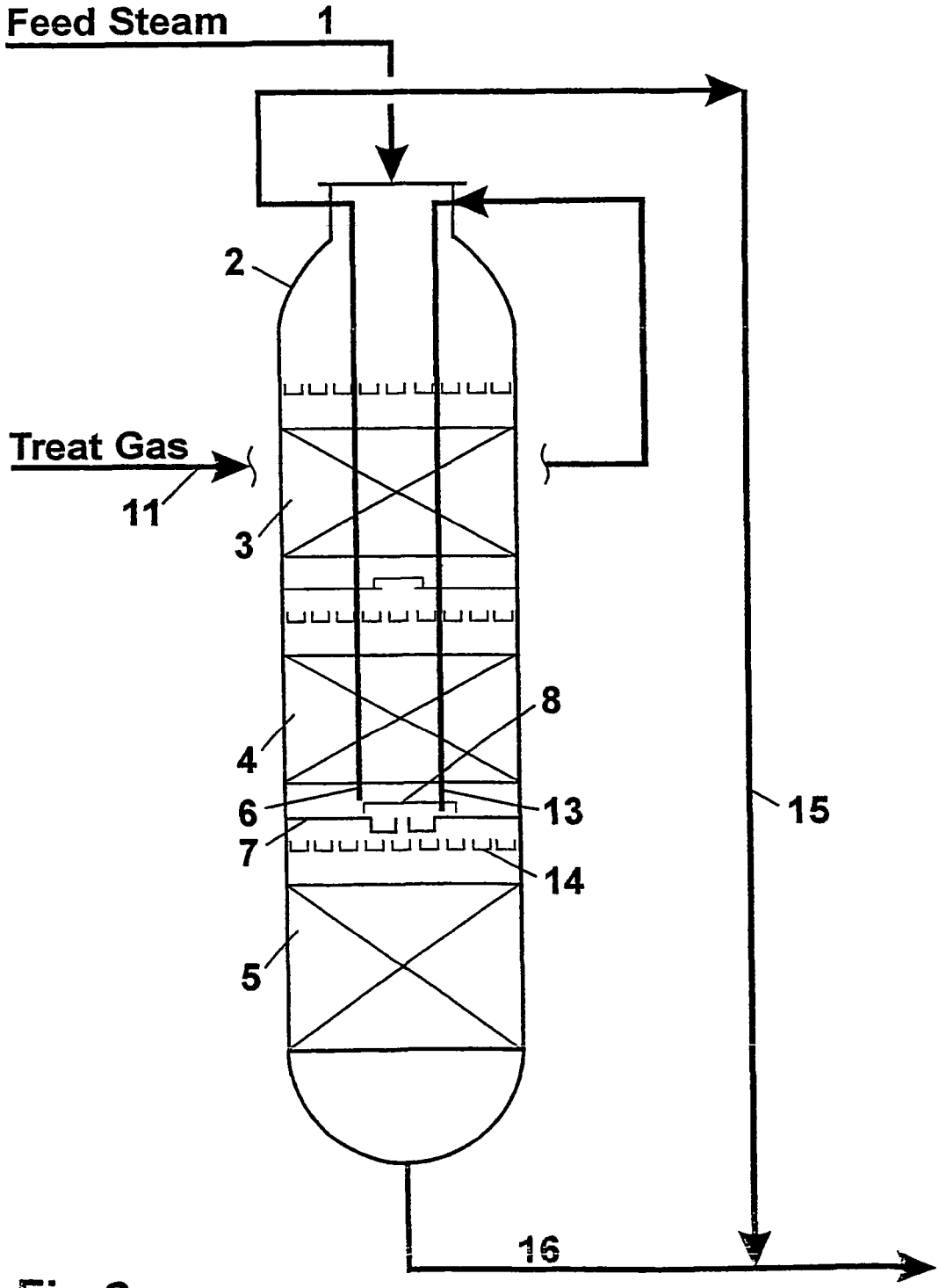
FIG. 3 shows a retrofitted hydroprocessing reactor with internal phase separation and addition of fresh treat gas.

FIG. 3 shows a typical hydrotreater which is revamped in accordance with the process of the invention and where the interbed separation takes place inside the reactor. Feed stream 1 containing admixed heavy hydrocarbon feed and hydrogen rich gas is introduced to the hydrotreater 2 containing three catalyst beds, the two upper beds 3 and 4 are loaded with catalyst active in hydrogenation of organic sulphur and nitrogen compounds and aromatic compounds and in some hydrocracking, the lower bed 5 is loaded with catalyst active in hydrocracking. The effluent from second catalyst bed is separated above tray 7 by means of separation/mixing device 8. The liquid phase flows under device 8, while the gas phase is withdrawn by riser 6, extending from top of reactor and down to above the tray 7. The fresh hydrogen rich treat gas 11 enters the hydrotreater 2 at the top and is led down by downcomer 13 to the separating/mixing device 8, where it is admixed with the liquid phase. The catalyst poisons $H_2S$ and $NH_3$ and the light hydrocarbons are removed by the gaseous effluent 15 and clean process stream enters the third catalyst bed 5, where liquid hydrocarbon is hydrocracked. The reactor effluent 16 is admixed with the gaseous effluent 15 for further processing.

Figure 4:
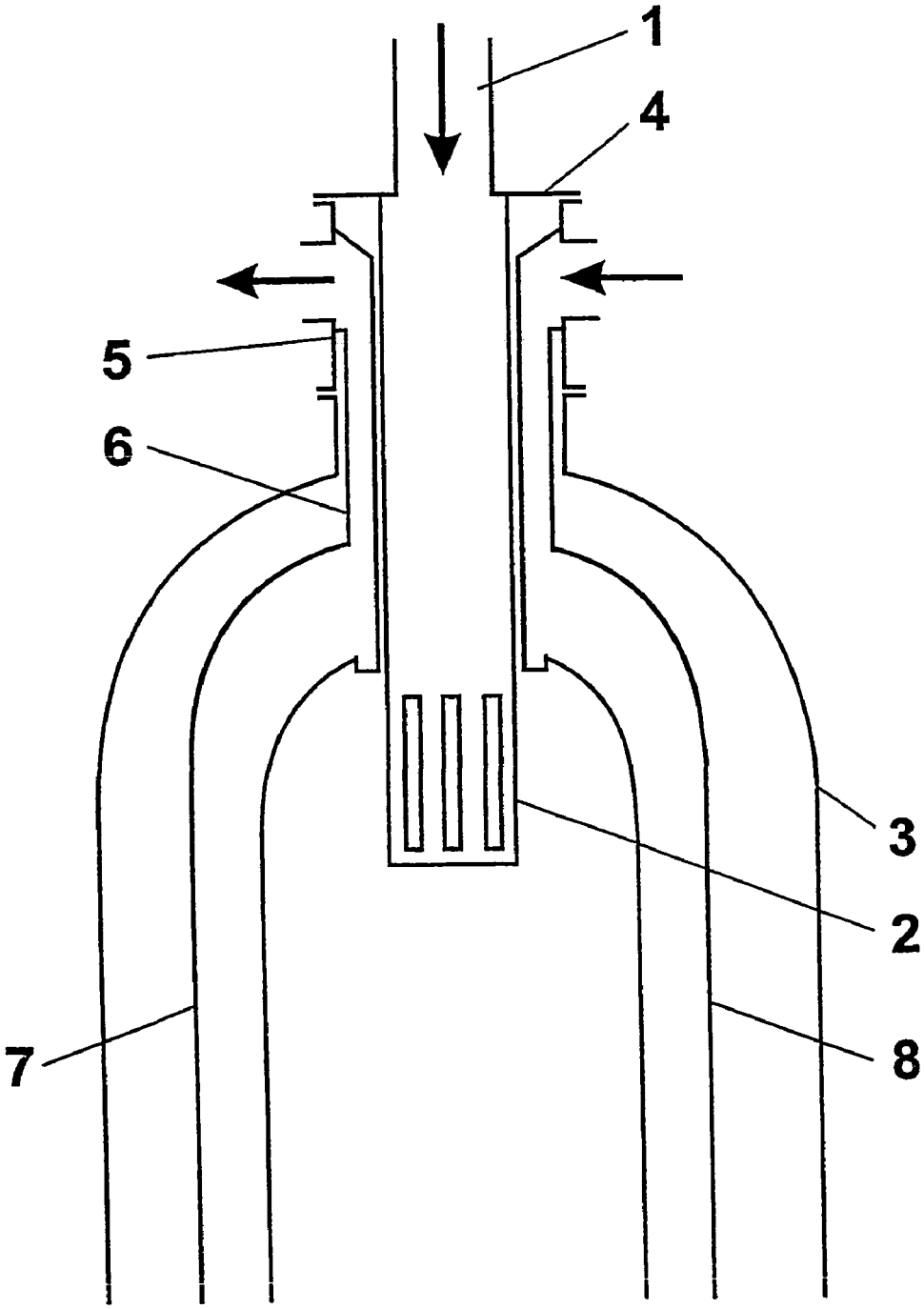
FIG. 4 shows the inlet/outlet system for interbed process streams at top of a retrofitted reactor.

FIG. 4 shows the essential parts of inlet/outlet arrangement at top of reactor. The reactor inlet stream enters the reactor through original inlet 1 and flows through inlet distributor 2, which is extended or replaced. Between reactor shell 3 and manhole cover 4 a spool piece 5 is installed containing the connecting duct 6 to riser 7 and downcomer 8.

Figure 5:
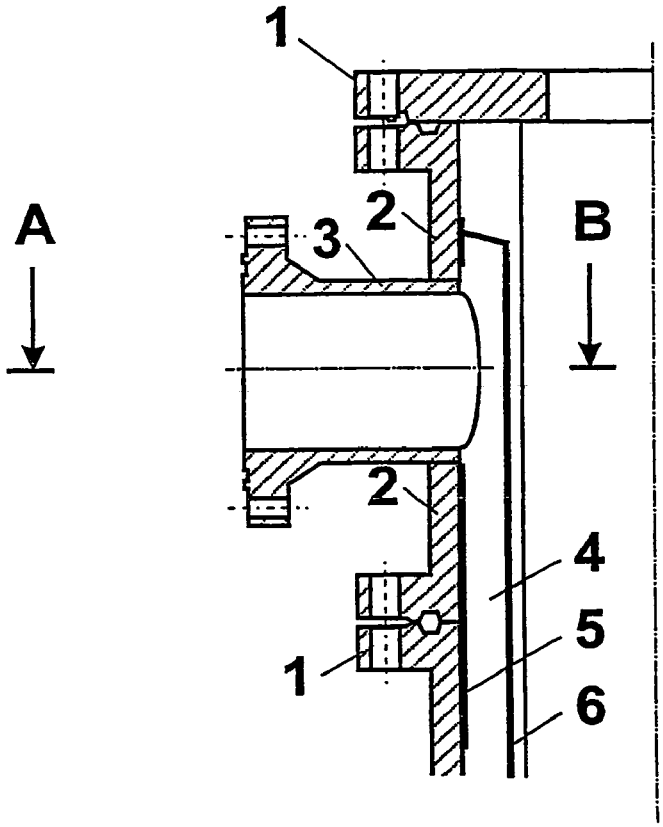
FIG. 5 discloses a new cylindrical piece to be installed at top and with the ducts connecting the riser/downcomer in a retrofitted reactor.

FIG. 5 shows flanges 1 on the original reactor and the flanged spool piece 2 to be installed between flanges 1. On the spool piece, nozzles 3 connecting reactor and separator are placed. Duct 4 connecting inlet/outlet and riser/downcomer is formed by plate 5 being welded to the inside of the spool piece and plate 6 being welded to plate 5.

Figure 6:
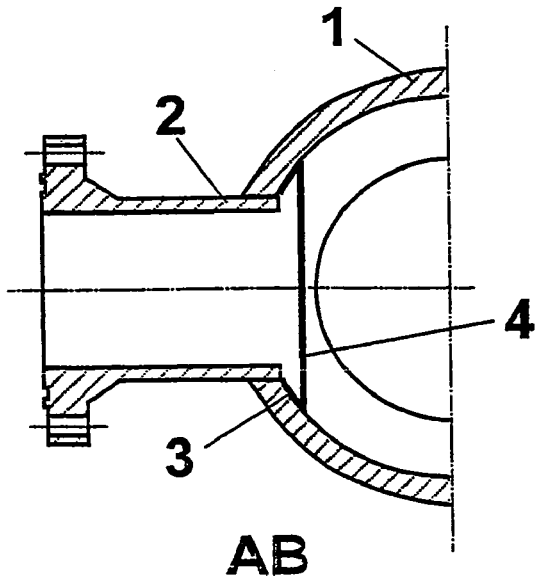
FIG. 6 shows a horizontal cross section of the inlet/outlet nozzle and duct of FIG. 5.

The same is shown in a horizontal cut AB on FIG. 6, where cylindrical spool piece 1, nozzle 2, the outer plate of the duct 3 and the inner plate of the duct 4 are shown.

Figure 7:
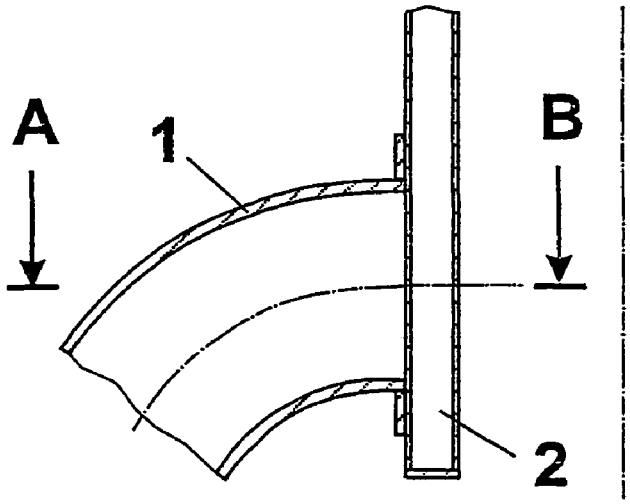
FIG. 7 shows the connection between the vertical oulet/inlet duct and riser/downcomer.

FIG. 7 illustrates how the bend of a riser/downcomer 1 and the duct 2 are connected to each other.

Figure 8:
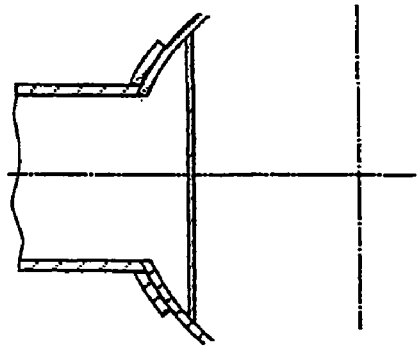
FIG. 8 is a horizontal cross section of the connection shown on FIG. 7.

A horizontal cut, AB, of FIG. 7 is shown on FIG. 8.

EXAMPLE

The Table below summarises yields obtained by processes without and with withdrawing gas phase between catalyst beds (Interbed ProdRec) in a hydroprocessing reactor unit handling 4762.5 $m^3$/day (30,000 barrels per stream day) of a vacuum gas oil having a specific gravity of 0.9272.

The Table discloses approximate prices of the products and hydrogen, the amount of product obtained with a conventional process and with interbed recycle expressed as percentage of weight of feed flow and prices of the obtained products and consumed hydrogen for the conventional process and for the process of the invention. From the Table it appears that the value of the product is increased by 3.5% and the hydrogen consumption is decreased by 15%.

| | |
|---|---|
| Plant Capacity | 4762.5 $m^3$/day |
| Specific Gravity | 0.9272 |
| Feed Flow | 184 ton/hr |
| On-stream Factor | 0.95 |
| Operating Days/Year | 347 |

Product Value Comparison

| | Upgrade | Yields Base Interbed | | Product Upgrade Value | |
|---|---|---|---|---|---|
| | value | Case | ProdRec | Base Interbed | |
| | $/ton | % woff | % woff | MM $/yr | MM $/yr |
| LPG | 40 | 2.63 | 1.92 | 1.6 | 1.2 |
| Light Naphtha | 54 | 4.88 | 3.37 | 4.0 | 2.8 |
| Heavy Naphtha | 49 | 17.80 | 8.84 | 13.4 | 6.7 |
| Jet Fuel/-kerosene | 70 | 20.11 | 22.61 | 21.6 | 24.3 |
| Diesel | 54 | 24.78 | 36.07 | 20.5 | 29.9 |
| UCO | 27 | 29.79 | 27.19 | 12.3 | 11.3 |
| Total | | 100.00 | 100.00 | 73.5 | 76.1 |

| | Unit Cost | Consumption | | Cost | |
|---|---|---|---|---|---|
| | $/ton | $Nm^3$ | $m^3$ | MM$/yr | MM$/yr |
| Hydrogen | 500 | 325 | 276 | 24.1 | 20.5 |

The invention claimed is:

1. A process for hydroprocessing a hydrocarbon feed comprising the steps of (a) admixing the feed with a hydrogen rich gas and obtaining a first admixed process stream;

(b) contacting the first admixed process stream with a first catalyst being active in hydrocracking of hydrocarbon compounds and obtaining a first catalyst effluent process stream;

(c) separating the first catalyst effluent process stream in a gas phase stream and a liquid phase stream, and withdrawing the gas phase stream;

(d) admixing the liquid phase stream with a hydrogen rich gas and obtaining a second admixed process stream;

(e) contacting the second admixed process stream with a second catalyst being active in hydrocracking of hydrocarbon compounds and obtaining a second catalyst effluent process stream;

(f) withdrawing and admixing the second catalyst effluent process stream with the gas phase stream obtained in step (c); and (g) withdrawing the admixed process stream provided in step (f), wherein ammonia is added after step (c) and prior to step (e);

further comprising the steps of, in the one or more hydroprocessing reactors prior to step (a):

installing a flanged spool piece between an existing man hole flange at top of the reactor;

retrofitting existing mixer plates to partition plates;

installing risers extending from top of reactor to upper surface of the partition plate between the catalyst beds and installing downcomers extending from top of the reactor to lower surface of the partition plate; and providing ducts connecting nozzles on the spool piece with the risers and the downcomers.

2. A process for hydroprocessing a hydrocarbon feed comprising the steps of (a) admixing the feed with a hydrogen rich gas and obtaining a first admixed process stream;

(b) contacting the first admixed process stream with a first catalyst being active in hydrocracking of hydrocarbon compounds and obtaining a first catalyst effluent process stream;

(c) separating the first catalyst effluent process stream in a gas phase stream and a liquid phase stream, and withdrawing the gas phase stream;

(d) admixing the liquid phase stream with a hydrogen rich gas and obtaining a second admixed process stream;

(e) contacting the second admixed process stream with a second catalyst being active in hydrocracking of hydrocarbon compounds and obtaining a second catalyst effluent process stream;

(f) withdrawing and admixing the second catalyst effluent process stream with the gas phase stream obtained in step (c); and (g) withdrawing the admixed process stream provided in step (f), wherein ammonia is added after step (c) and prior to step (e);

further comprising the steps of, in the one or more hydroprocessing reactors prior to step (a):

installing a flanged spool piece between an existing man hole flange at top of reactor;

retrofitting existing mixer plates to trays with separating/mixing device;

installing risers extending from top of the reactor to upper surface of the modified separating/mixing device and installing downcomers extending from top of the reactor to lower surface the separating/mixing device; and providing ducts connecting nozzles on the spool piece with the risers and the downcomers.

3. Method for retrofitting an existing hydroprocessing reactor for use in a process for hydroprocessing a hydrocarbon feed comprising the steps of (a) admixing the feed with a hydrogen rich gas and obtaining a first admixed process stream;

(b) contacting the first admixed process stream with a first catalyst being active in hydrocracking of hydrocarbon compounds and obtaining a first catalyst effluent process stream;

(c) separating the first catalyst effluent process stream in a gas phase stream and a liquid phase stream, and withdrawing the gas phase stream;

(d) admixing the liquid phase stream with a hydrogen rich gas and obtaining a second admixed process stream;

(e) contacting the second admixed process stream with a second catalyst being active in hydrocracking of hydrocarbon compounds and obtaining a second catalyst effluent process stream;

(f) withdrawing and admixing the second catalyst effluent process stream with the gas phase stream obtained in step (c); and (g) withdrawing the admixed process stream provided in step (f), wherein ammonia is added after step (c) and prior to step (e);

the method for retrofitting comprising the steps of, in an existing reactor shell:

installing a flanged spool piece between an existing man hole flange at top of the reactor;

retrofitting existing mixer plates to partition plates;

installing risers extending from top of the reactor to upper surface of the partition plate between two catalyst beds and installing downcomers extending from top of the reactor to lower surface of the partition plate;

and providing ducts connecting nozzles on the spool piece with the risers and the downcomers.

4. The method of claim 3, wherein the at least one partition plate in the form of a tray with separating/mixing device is installed.

5. The method of claim 3, wherein at least one existing distribution plate installed a top of a catalyst bed is replaced by a distribution plate with vapour lift tubes.

* * * * *